United States Patent [19]

Anderson

[11] 4,445,037

[45] Apr. 24, 1984

[54] APPARATUS FOR MONITORING TRITIUM IN TRITIUM CONTAMINATING ENVIRONMENTS USING A MODIFIED KANNE CHAMBER

[75] Inventor: David F. Anderson, Los Alamos, N. Mex.

[73] Assignee: The United States of America as represented by the United States Department of Energy, Washington, D.C.

[21] Appl. No.: 229,024

[22] Filed: Jan. 27, 1981

[51] Int. Cl.[3] ..... H01J 47/02

[52] U.S. Cl. ..... 250/380; 250/379

[58] Field of Search ..... 250/380, 379, 385, 374

[56] References Cited

U.S. PATENT DOCUMENTS 2,499,830 3/1950 Molloy ..... 250/380

3,084,255 4/1963 Brinkerhoff et al. ..... 250/380

OTHER PUBLICATIONS

Jalbert, "A Monitor for Tritium in Air Containing Other Beta Emitters", Proc. 23rd Conf. on Remote Systems Tech., San Francisco, Nov. 17-20, 1975.

Hoy, "Operational Experience with Kanne Ionization Chambers", Health Physics, Pergamon Press, vol. 6, 1961, pp. 203-210.

*Primary Examiner*—Alfred E. Smith

*Assistant Examiner*—Carolyn E. Fields

*Attorney, Agent, or Firm*—Samuel M. Freund; Paul D. Gaetjens; Michael F. Esposito

[57] ABSTRACT

A conventional Kanne tritium monitor has been redesigned to reduce its sensitivity to such contaminants as tritiated water vapor and tritiated oil. The high voltage electrode has been replaced by a wire cylinder and the collector electrode has been reduced in diameter. The area sensitive to contamination has thereby been reduced by about a factor of forty while the overall apparatus sensitivity and operation has not been affected. The design allows for in situ decontamination of the chambers, if necessary.

7 Claims, 2 Drawing Figures

APPARATUS FOR MONITORING TRITIUM IN TRITIUM CONTAMINATING ENVIRONMENTS USING A MODIFIED KANNE CHAMBER

The invention is a result of a contract with The Department of Energy (Contract No. W-7405-ENG-36).

BACKGROUND OF THE INVENTION

The present invention relates generally to quantitative ionizing radiation detectors and morek particularly to a tritium monitoring system.

One of the considerations in the operation of heavy-water moderated reactors is the measurement of the radioisotope, tritium. Further, with tritium-fueled fusion reactors nearing reality and research in this area growing enormously with time, tritium monitoring is becoming increasingly important to those whose responsibility includes human hazard prevention and detection. The Kanne chamber (see, e.g., J. E. Hoy, Health Physics 6, 203 (1961)) has been used for more than twenty years to monitor radioactive gases. It is especially suitable for monitoring weak beta particle emitters since their range in air is short when compared with the overall dimensions of such chambers. Other more energetic gaseous radioisotopes are detected with reduced efficiency since less energy is deposited in the chamber itself and more lost to the surrounding walls. A conventional embodiment of this device consists of three concentric cylinders, the inner and outer of these being held at ground potential while the intermediate cylinder is operated at approximately 200 V. The region between the outer and intermediate cylinders serves as an ion trap. This allows the device to detect tritium beta particle emission from gas actually present within and passing through the ion chamber which comprises the intermediate cylinder and inner cylinder, free from previous ionizing events. Decomposition of radionuclides present in the ion chamber is detected by means of a current developed between the inner and intermediate electrodes as a result of migration of charged species formed when the energy of the emitted particles is deposited in the air surrounding the electrodes. Meaningful calibration and detection can thereby be achieved. Typically, 51.6 liters is the active volume since high sensitivity is a function of volume for this type of device. When the Kanne device is used to detect tritium in the ambient breathing air, contamination is not a problem. However, when exposed to high concentrations of radioactive gases such as HTO, for example, or gases contaminated with tritiated oil, a buildup of background activity may occur which significantly reduces the sensitivity of the chamber to low tritium concentrations. Further, electronic compensation for a large background is difficult and often unreliable. Restoration of the uncontaminated sensitivity may require procedures ranging from simple purging of the chamber for several hours with clean air to more drastic heating or disassembly and cleaning with their more significant down time. Occasionally, a badly contaminated unit may have to be discarded.

In order to reduce the problem of contamination and improve the ability to decontaminate the chamber when that occasion arises, the apparatus of the instant invention is designed to operate with significantly diminished contamination sensitive area; that is, the surface area which when contaminated destroys the high sensitivity of the apparatus is substantially reduced without deleterious effects on its overall operation. This is achieved by replacing the solid high voltage cylinder of the conventional Kanne chamber by an open, wire cylinder of comparable dimensions, and the usual solid, cylindrical central collector electrode by a much smaller surface area rod. The instant design allows most required decontamination to be accomplished with the chamber assembled, and permits existing Kanne chambers to be trivially retrofitted with the improved electrodes. Since our design does not include an internal deionizer, an external deionizer is attached.

At the present time, the principle reference relating to the instant invention is the Hoy article, supra, which describes the construction and operation of conventional Kanne chambers. The most important difficulty with this very useful device, that of possible contamination with subsequent loss of sensitivity, has been briefly discussed herein above. Hoy teaches that few contamination problems exist if the air to be analyzed is filtered, but that residual activity may build up when high concentrations of radioisotopes are passed through the chamber. In this event, Hoy has found that several hours of dry air purging and heating may remove many gaseous contaminants, but disassembly and cleaning for more severe contamination is sometimes necessary. The modifications taught by our apparatus take advantage of all of the positive aspects of the Kanne design, while essentially eliminating the contamination problem. Further, said modifications can be easily adapted to existing Kanne units.

SUMMARY OF THE INVENTION

An object of the apparatus of the instant invention is to monitor low concentrations of radioactive gases with reduced sensitivity to radioactive contamination.

Another object of our invention is to monitor tritium in its various gaseous forms.

Yet another object of the instant apparatus is to enable existing, contaminated conventional Kanne chambers to be easily retrofitted with the present apparatus.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purpose of the present invention, as embodied and broadly described herein, the apparatus of this invention may include a number of parallel wires connected in parallel and supported in a cylindrical configuration forming a high voltage electrode, a small diameter rod placed along the axis of the high voltage electrode serving as a collector electrode, a solid cylindrical enclosure which surrounds the electrodes and includes flanges, insulators support structures and tubes such that said electrodes can be electrically isolated and immersed or bathed in the gases to be analyzed, an external deionizer to remove ionization products from radioactive events not occurring within the detection apparatus, and a mechanical filter for removing particulates.

The design advantages of the apparatus of the instant invention are threefold. First, the contamination sensitive area of the electrodes has been significantly reduced with little change in overall performance of the monitor. That is, the region between the high voltage cylinder and the central collector rod is severely affected by radioactive contaminants accumulating on any surfaces since ions produced from the decomposition process are readily detected. By reducing the available area for absorption, contamination is no longer a serious problem. Second, if the need arises, the high voltage wires can be decontaminated in place by passing an electric current through them thereby causing them to heat up and boil off any easily vaporizable matter. Finally, since beta particles emitted from tritium decomposition have a maximum range in air of 0.7–1.0 cm depending on the atmospheric pressure, any contaminants residing on the inner surface of the solid cylindrical enclosure will not produce beta particles which will enter the detection region between the high voltage cylinder and the collector electrode since all surfaces outside of said high voltage cylinder are greater than 1 cm from the wires. The improved Kanne tritium monitoring apparatus of the instant invention should therefore greatly improve the monitoring capability of low concentrations of tritium, particularly in contaminating environments as a result of the substantial reduction of surfaces which can be contaminated and the concomitant ease with which the remaining surfaces can be decontaminated in situ without substantial down time.

DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Reference will now be made in detail to the present preferred embodiment of the invention, an example of which is illustrated in the accompanying drawings. A conventional 51.6 liter Kanne chamber as described by Hoy, supra, consists of three concentric cylinders, with the inner and outer cylinders at ground potential and the intermediate cylinder operated at about 200 V. The large active volume gives rise to the high sensitivity of the device. The region between the outer and intermediate cylinders serves as an ion trap, the gas to be analyzed being flowed through this annular region before entering the ion chamber formed by the intermediate cylinder and the inner cylnder, the latter acting as the collector electrode. The gas then exits the device. Radionuclide decomposition occurring within the ionization region is detected by a current developed between the two inner electrodes as a result of the decomposition energy being deposited in the carrier gas passing through this region with the consequent formation and migration of ions and is usually measured with an electrometer with a logarithmic scale covering the current range between $10^{-13}$ to $10^{-7}$ A. The above Kanne device has been used for more than 20 years to monitor radioactive gases. Under favorable conditions, $<1$ DAC (derived air concentration ($5\times10^{-6}$ $\mu$Ci/cc)) of HTO can be measured with this system. The major problem with the Kanne chamber is that because of the large surface area of the cylindrical electrodes, it tends to build up a radioactive background on such surfaces, greatly reducing the sensitivity of the device to low tritium concentrations. Techniques to compensate for this background such as electronically subtracting a large background current from the observed signal (background plus signal of interest) are often unreliable especially when very small signals are being measured. In order to improve the sensitivity of the Kanne chamber to tritium and to increase the ease of determining the total amount of tritium passing through such a radiation monitor, I have redesigned the Kanne device and employed more modern electronics as part of my invention.

Figure 1:
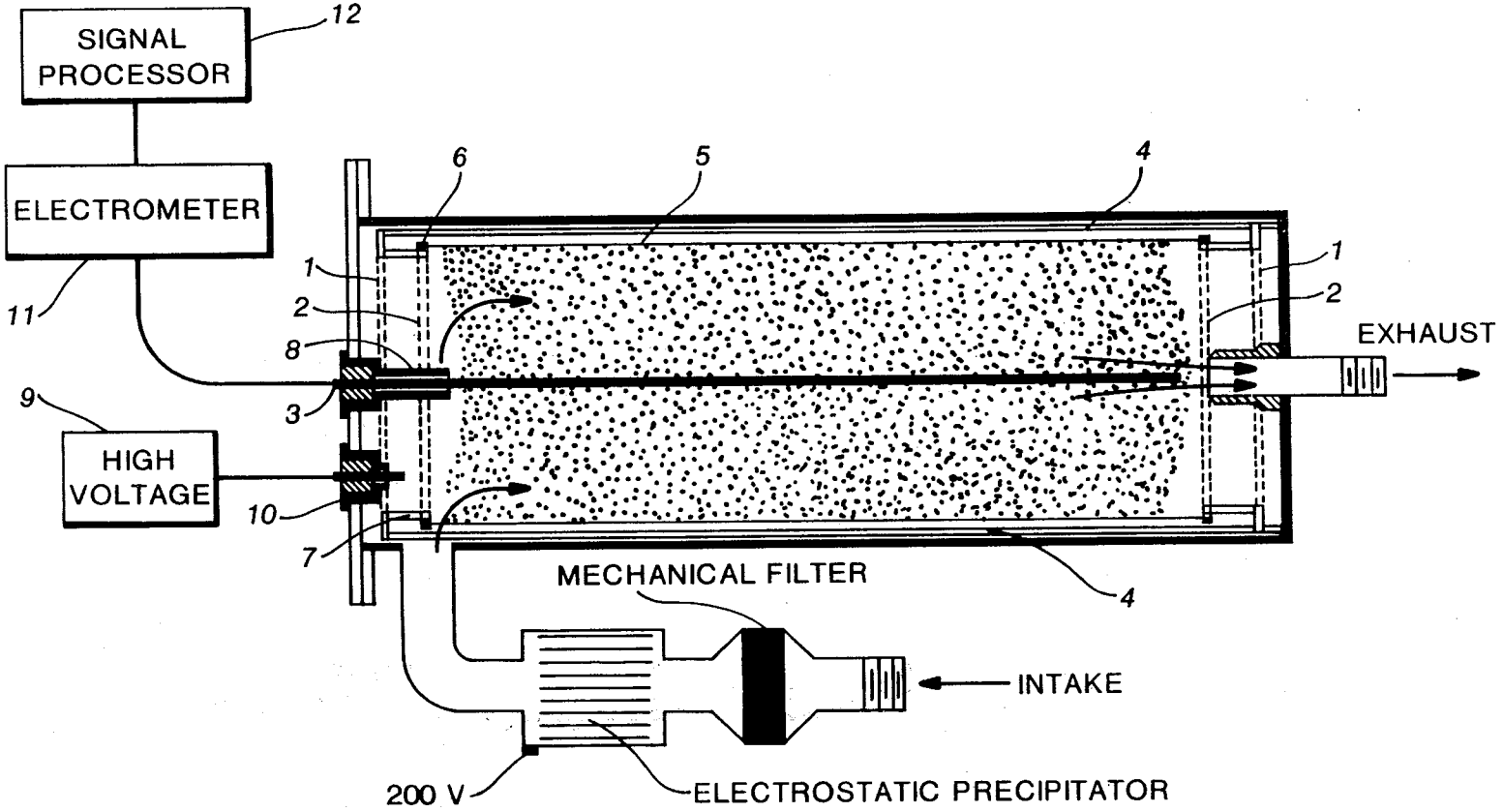
FIG. 1 shows a perspective view of the apparatus of the instant invention as it is used for monitoring tritium.

FIG. 1 shows the design of the improved Kanne chamber. The objective was to reduce the sensitive area; that is, the surfaced area whose contamination contributed to the background of the chamber. For reasons to be explained below, only the two inner electrodes needed to be changed. The high voltage cylinder of the conventional Kanne monitor was replaced by a wire cylinder 5 about 78.7 cm long and about 30.5 cm in diameter, and comprising forty-five approximately 0.02 cm diameter nichrome wires running parallel to the cylinder axis and along its surface. The wires are spaced at about 1.07 cm intervals and are attached to a high voltage source 9 through a connector 10. The conventional 7.6 cm diameter central collector electrode located along the cylindrical axis of the entire system was replaced with an about 0.64 cm diameter aluminum rod 3 with a sensitive length of approximately 77.2 cm.

Figure 2:
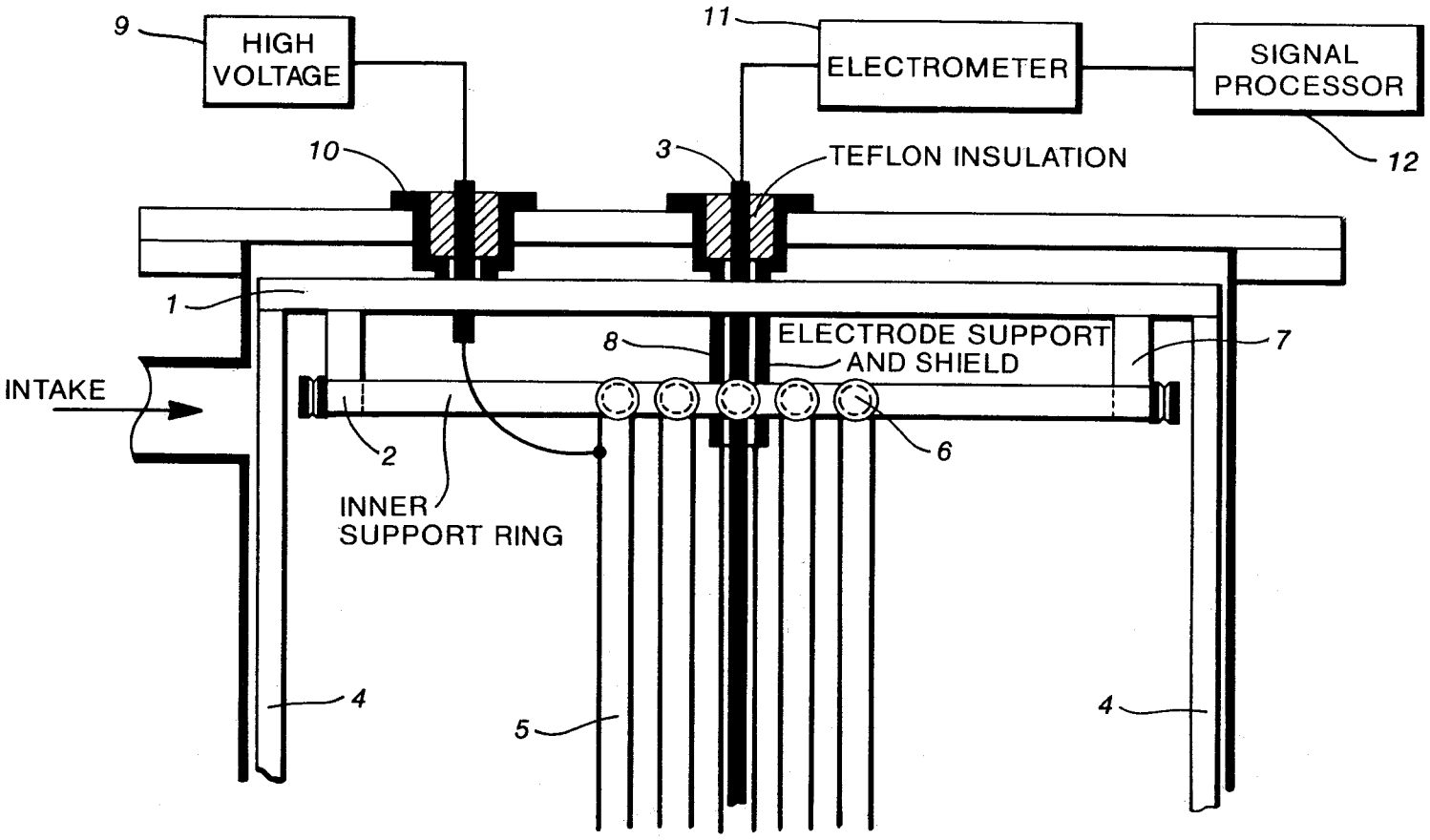
FIG. 2 shows an exploded view of the electrode design which embodies the improvement over the conventional Kanne design.

FIG. 2 shows a detailed drawing of the intake end of the chamber. The wires 5 are stretched between ninety ceramic pieces 6 on two inner support rings 2. These rings are connected to outer support rings 1 by six short rods 7. The outer support rings are themselves supported by eight connecting rods 4 fastened to the exhaust end of the chamber. All rings and rods are held at ground potential as is the chamber itself. This design greatly improves the ease of decontamination of the chamber should the need arise. The high voltage wires can be decontaminated in place by passing an electric current through them which results in their heating up. The center electrode 3 is held by four external screws and can be trivially removed for replacement or cleaning. The center electrode is attached to an electrometer 11 which is in turn attached to an appropriate signal processor 12 for processing and analyzing the small signal currents amplified by the electrometer. Therefore, in most instances, decontamination can be accomplished quickly and without the removal of the monitor from the system.

Since the design of the instant apparatus does not include an interval deionizer (the ion trap annulus mentioned above), an external deionizer is provided. It consists of twenty about 0.08 cm thick stainless steel plates spaced at approximately 0.32 cm centers. Alternate plates are connected to the same high voltage supply as is the high voltage cylinder in the modified Kanne chamber. The remaining plates are grounded. An external filter is used to remove dust and oil.

The maximum energy of a tritium beta particle is 18 keV with a mean energy of 5.6 keV. Thus, these particles have a maximum range in air of about 0.7 cm under standard conditions, with the mean range being slightly greater than 0.1 cm. At higher altitudes, where the air density is lower, maximum ranges can be about 1.0 cm. For this reason, all surfaces outside of the high voltage cylinder (that is, connecting rods and chamber wall) are greater than 1 cm from the wires. Since said support rings and chamber walls are grounded, the major part of any ionization arising from their contamination will terminate on these surfaces and not enter the ion chamber. The contamination will therefore have little effect on the signal. A shield 8 at the supported end of the collector electrode prevents detection of contamination from the support rings on the chamber end. As a result of the design changes, the sensitive area of the improved Kanne detector of the instant invention is less than about 266 $cm^2$ while that of a conventional Kanne chamber is about $1.1\times10^4$ $cm^2$. The apparatus of our invention, therefore has an electrode area of 1/40 that of existing devices with no consequent loss in performance.

The current produced by the ionizing events within the ion chamber for conventional Kanne systems is typically measured with an electrometer with a logarithmic scale which covers the range between $10^{-13}$ to $10^{-7}$ A. In order to determine the amount of tritium that has passed through the chamber, the area under the recording of the current versus time output from the electrometer must be integrated. A major problem with this measurement procedure is that there is no means of zeroing the electrometer to subtract a constant background arising perhaps from contamination. Therefore, the resulting numbers will have to be corrected for such background after they are recorded. In other words, the device in its conventional form is not direct reading. Our apparatus uses an electrometer 11 with $10^{-12}$ A full scale deflection on its most sensitive range with $10^{-16}$ A detectability. Both analog and digital signals are presented to output connectors for use in data acquisition systems 12. The electrometer operational amplifier and its associated high impedances are housed in a separate temperature-controlled oven which can be mounted on the tritium chamber to provide minium distance between the collector and the amplifier. There is insignificant variation in gain or instrument zero with changes in ambient temperature. The circuit design allows a steady-state background current arising in the chamber to be suppressed. Therefore, a constant background due to any contamination will not contribute to the integrated charge measured by the instrument of the instant invention, thereby rendering it a direct reading apparatus. It should be mentioned that our invention can also be operated with more common electrometers as current measuring devices.

The apparatus of the instant invention was calibrated by placing it in series with a conventional 51.6 liter Kanne chamber in an operating environment. The air to be analyzed was passed through the improved chamber before entering the latter chamber. The calibration for the improved chamber was found to be about $3.6\times10^{12}$ DAC per ampere compared with about $4.0\times10^{12}$ DAC per ampere for the conventional chamber. The apparatus of the instant invention therefore has realized a slight improvement in overall sensitivity of detection.

The calibration experiments were conducted using a very contaminating air source. The background of the conventional chamber was about $2\times10^{-12}$ A after approximately one month of use. This corresponds to a background of about 8 DAC. Upon installation of the tritium monitor of the instant invention the electrometer was zeroed. After 16 weeks of use under conditions giving rise to the contamination with its accompanying background for the conventional chamber, the zero did not require adjustment for our detector. With the apparatus of the instant invention, steady-state concentrations of about 0.02 DAC should be measurable even under contaminating environment conditions. Finally, it was found that when concentrations were of the order of 200 DAC, our detector gave readings which were slightly below (about 2%) those given by the conventional Kanne chambers. This is most certainly due to the smaller collecting electrode which allows more recombination at high concentrations.

In conclusion, the apparatus of the instant invention greatly improves the monitoring capability of low concentrations of radioactive gases in contaminating environments without interfering with the overall sensitivity and other positive features of conventional Kanne detectors or materially changing their operating characteristics. The reduction of sensitive surface area is clearly adaptable to smaller chambers. These smaller detectors are useful because they respond more rapidly and are less bulky. A one liter chamber should be capable of measuring concentrations of approximately 0.2 DAC. In the unlikely event that decontamination is actually necessary, in most cases it can be accomplished in situ by simply applying a heating current to the wires comprising the high voltage electrode, thereby reducing system down time. The application of modern data processing techniques to the analysis will significantly reduce the tedium associated with radioactivity evaluations using conventional Kanne chambers and methodology. In particular, the zero-offset feature of our electronics will simplify the data acquisition.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. Apparatus for detection and monitoring of radioactive gases comprising:

(a) means to reduce sensitivity to contaminants, said means comprising an open wire high voltage cylindrical electrode which includes equally spaced wires supported in a substantially parallel manner to the cylindrical axis of said high voltage electrode, said wires forming the surface of said high voltage electrode:

(b) a solid metal collector electrode located along said axis of said high voltage electrode, electrically isolated therefrom, said collector electrode being supported from one of its ends;

(c) means for supporting said high voltage electrode and said collector electrode such that said collector electrode and said high voltage electrode are electrically isolated from each other and from any nearby surfaces;

(d) a grounded cylindrical chamber which encloses said high voltage electrode, said collector electrode, and said supporting means, said chamber being gas impermeable, and electrically isolated from said high voltage electrode and said collector electrode, said high voltage electrode and collector electrode being the sole electrodes in said chamber;

(e) means for introducing and removing gas samples from said chamber;

(f) means for filtering and deionizing said gas samples before their introduction into said chamber;

(g) means for applying a high voltage to said high voltage electrode;

(h) means for extracting signal currents appearing on said collector electrode arising from radioactive decomposition within the region between said high voltage electrode and said collector electrode;

(i) means for amplifying, processing and analyzing said signal currents; and (j) means for shielding said supported end of said collector electrode from radioactive decompositions and subsequent ionizations occurring on said means for support and said chamber.

2. The apparatus according to claim 1, wherein said radioactive gases include at least one gas selected from the group consisting of tritium and tritium-bearing gases.

3. The apparatus as described in claim 2, wherein said high voltage electrode is about 79 cm long, about 30 cm in diameter and comprises forty-five series connected about 0.02 cm diameter nichrome wires spaced about every 1 cm disposed in a substantially parallel manner to said cylindrical axis forming said surface of said high voltage electrode, and wherein said collector electrode comprises an about 0.6 cm diameter electrically conducting rod with a sensitive length of approximately 77 cm located along said axis of said high voltage electrode.

4. The apparatus as described in claim 3, wherein said means for support for said high voltage electrode includes ninety ceramic locating pieces mounted on two inner support rings, said inner support rings being disposed in a substantially parallel manner at opposite ends of said high voltage electrode and having their axes of symmetry located substantially along said axis of said high voltage electrode, said series connected wires being stretched between said inner support rings and rigidly located by said ceramic locating pieces, each of said inner support rings being fastened to an outer support ring, each of said outer support rings being disposed in a substantially parallel manner to each other and to said inner support rings and having its axis of symmetry located substantially alog said axis of said high voltage electrode by at least one short rod, said outer support rings being spaced apart and positioned by at least one supporting rod, said supporting rod being fastened to the inside of said cylindrical chamber at the opposite end of said enclosure to which said collector electrode is fastened, said inner support rings, said outer support rings, said short rods, and said supporting rods being held at ground potential.

5. The apparatus as described in claim 4, wherein said applied voltage is approximately 200 V, and said collector electrode is maintained at about ground potential.

6. The apparatus as described in claim 5, wherein said means for extracting said signal currents from said collector electrode includes an electrometer with a high impedance operational amplifier which suppresses a steady-state background current.

7. The apparatus as described in claim 6, wherein said means for externally filtering and deionizing said gas samples, includes twenty about 0.08 cm thick electrically conducting plates disposed in a substantially parallel manner and spaced apart at approximately 0.3 cm centers, alternate plates being held at ground potential and being charged to approximately 200 V.

* * * * *